US006129297A

United States Patent [19]

Sawant et al.

[11] Patent Number: 6,129,297

[45] Date of Patent: Oct. 10, 2000

[54] CONE CRUSHER WITH WEAR INDICATOR

[75] Inventors: Ulhas S. Sawant, Hartland; Wayne G. Chmiel, Waukesha, both of Wis.

[73] Assignee: Martin Marietta Materials, Inc., Raleigh, N.C.

[21] Appl. No.: 08/902,705

[22] Filed: Jul. 30, 1997

[51] Int. Cl.[7] ..... B02C 2/00

[52] U.S. Cl. ..... 241/101.3; 29/428; 241/207

[58] Field of Search ..... 241/101.3, 207–216; 29/428

[56] References Cited

U.S. PATENT DOCUMENTS

| | | | |
|---|---|---|---|
| 2,594,080 | 4/1952 | Shafter | 241/299 |
| 2,913,189 | 11/1959 | Werner | 241/295 |
| 3,314,618 | 4/1967 | McDonald | 241/207 |
| 3,384,312 | 5/1968 | Patterson et al. | 241/208 |
| 3,497,146 | 2/1970 | May | 241/293 |
| 3,619,439 | 11/1971 | Rea | 264/148 |
| 3,834,633 | 9/1974 | Dougall et al. | 241/295 |
| 3,850,376 | 11/1974 | Mertz | 241/207 |
| 5,249,778 | 10/1993 | Steichert et al. | 266/220 |
| 5,303,756 | 4/1994 | Hill | 152/197 |
| 5,516,053 | 5/1996 | Hannu | 241/207 |
| 5,603,161 | 2/1997 | Welsh | 30/346.52 |
| 5,746,891 | 5/1998 | Withers | 162/369 |

FOREIGN PATENT DOCUMENTS

| | | |
|---|---|---|
| 1 507 480 | 6/1969 | Germany . |
| 0101554 | 8/1979 | Japan . |

*Primary Examiner*—Mark Rosenbaum

[57] ABSTRACT

A cone crusher with wear indicator. The cone crusher comprises a frame, a head rotatably supported on the frame, a bowl supported on the frame in spaced relation to the head, a liner mounted on one of the head and the bowl, and an indicator for indicating wear of the liner. Preferably, the indicator includes a recess defined by the liner, and the recess is revealed upon erosion of the wearing surface of the liner. Preferably, the cone crusher further comprises a backing material between the liner and the one of the head and the bowl. The backing material preferably fills the recess and is different from the material of which the liner is formed.

15 Claims, 4 Drawing Sheets

CONE CRUSHER WITH WEAR INDICATOR

FIELD OF THE INVENTION

The present invention generally relates to the field of crushers used to crush aggregate into smaller pieces. More specifically, the present invention relates to cone crushers having opposed crushing surfaces.

BACKGROUND OF THE INVENTION

Crushers are used to crush large aggregate particles (e.g., rocks) into smaller particles. One particular type of crusher is known as a cone crusher. A typical cone crusher includes a frame supporting a crusher head and a mantle secured to the head. A bowl and bowl liner are supported by the frame so that an annular space is formed between the bowl liner and the mantle. In operation, large particles are fed into the annular space between the bowl liner and the mantle. The head, and the mantle mounted on the head, rotate eccentrically about an axis, causing the annular space to vary. As the distance between the mantle and the bowl liner varies, the large particles are impacted and compressed between the mantle and the bowl liner. The particles are crushed and reduced to the desired product size, and then drop down from between the mantle and bowl liner.

The process of impacting and crushing aggregate causes the mantle and the bowl liner to wear.

SUMMARY OF THE INVENTION

In existing cone crushers, the mantle and the bowl liner are periodically replaced after a specified number of operational hours. Such replacement prevents excessive wear of the mantle and bowl liner and prevents damage the head or the bowl. The cost of "down time" for replacing worn components of a cone crusher can be substantial, and premature replacement of such components increases the cost of cone crusher maintenance. In addition, in the event worn components are not replaced in a timely manner, damage to the head and the bowl can be expensive in terms of the cost of the repair parts and the cost of the down time to repair the cone crusher.

Despite monitoring crusher operation and recording the operational service of cone crusher mantles and bowl liners, conventional cone crushers are nevertheless occasionally damaged by excessive wear on the bowl liner and the mantle, to the point of exposing the underlying head or bowl to the aggregate processed by the crusher. Failure of the monitoring measures to accurately predict mantle and bowl liner service life is attributable to several factors. First, the crushing surface provided by a mantle or bowl liner can wear unevenly. Second, the abrasiveness of the crushed aggregate can vary, and operational parameters also vary service life.

In addition, because the bowl liner and mantle are somewhat difficult to replace, the actual thickness of these members is not observed or measured during the operation of conventional crushers. In this regard, there is a tendency for crusher operators to continue operation of a crusher without replacing the crushing surfaces if, on visual inspection, it appears that the installed mantle and bowl liner have additional service capacities. Also because of the difficulty in ascertaining liner thickness in prior art cone crusher designs, liners can sometimes be replaced prematurely, i.e., before the liner thickness has become critically eroded. Such premature replacement of liners and liner components is also costly both in terms of wasted liner life and, over a long term of crusher operation, in terms of crusher down time.

To overcome these problems, the invention provides a cone crusher with a crushing surface wear indicator. In particular, the invention provides a liner having a crushing surface and either a void or empty recess filled with an indicator material that is exposed through erosion of the crushing surface. Upon a predetermined degree of erosion, the empty recess or the indicator material becomes observable, thus indicating the degree of wear on the crushing surface.

More particularly, in one embodiment, the cone crusher comprises a frame, a head rotatably supported on the frame for eccentric rotation, a bowl surrounding a portion of the head, and a liner mounted on the head or the bowl. The liner has a wearing or crushing surface for engaging the material to be crushed, a non-wearing surface opposite the crushing surface, and a recess located between the crushing surface and the non-wearing surface. The recess is revealed upon a predetermined degree of erosion of the crushing surface. In the preferred embodiment, the non-wearing surface defines a plurality of recesses. Additionally, the cone crusher may further comprise a second liner mounted on the other of the head and the bowl. The second liner is similar to the first liner and also provides a crushing surface and wear indicator.

The invention also provides a liner for a cone crusher. The liner comprises a generally frusto-conical body adapted to be mounted on the head or the bowl of the cone crusher. The body has a first surface for engaging a material to be crushed and a second surface which faces opposite the first surface and which faces the head or the bowl. The second surface defines a recess extending toward the first surface and having an apex. When the first surface is worn, the apex of the recess is revealed through the first surface.

In the preferred embodiment, the second surface defines a plurality of spaced apart recesses. The recesses may be spaced apart in the second surface with respect to the axis of the liner or about the circumference of the liner. Further, the recesses may be spaced apart to form a helix arrangement in the second surface. In another embodiment, the recess may be a groove. The second surface may also define a plurality of spaced apart grooves or a single groove having a helical arrangement.

Additionally, the liner may be used in conjunction with a filler material in the recess. The filler material may be between the second surface and the support surface of the head or the mantle. In one embodiment, the filler material may include a plurality of layers that each indicate an amount of wear of the liner. In a similar manner, the recess may have a cross-section that varies with the depth to indicate the amount of wear of the liner.

The invention further provides a cone crusher comprising a head providing a first wearing surface, a bowl providing a second wearing surface spaced from the first wearing surface, and means for indicating wear of one of the wearing surfaces. Preferably, the head or the bowl includes a liner providing the wearing surface, and the means for indicating wear of one of the wearing surfaces indicates wear of the liner. The means for indicating wear of the liner includes a recess defined by the non-wearing surface of the liner. The recess is revealed through the wearing surface when the liner is worn. Further, the means for indicating wear of the liner may include a groove defined by the non-wearing surface of the liner.

In addition, the means for indicating wear of one of the wearing surfaces may include a filler material which is revealed through the wearing surface to indicate that the surface is worn. The filler material may be located between the non-wearing surface of the liner and the support surface of the head or the bowl. The filler material may include a plurality of layers, each indicating an amount of wear of the one of the wearing surfaces.

An advantage of the present invention is that the amount of wear or erosion actually experienced by a crushing surface is indicated in a manner that is easily observable and that does not require disassembly of the crusher. In addition, the present invention indicates when the liner should be replaced, i.e., after a predetermined degree of erosion of the crushing surface. This ensures that the liner is not overused but is replaced before crusher parts, such as the head and the bowl, are damaged. This also ensures that the liner is not prematurely replaced, thereby maximizing its useful life. The invention results in reduced operational costs associated with the cone crusher, including reduced cost of repair parts and reduced time to repair.

Other features and advantages of the invention will become apparent to those skilled in the art upon review of the following detail description, claims and drawings.

Figure 1:
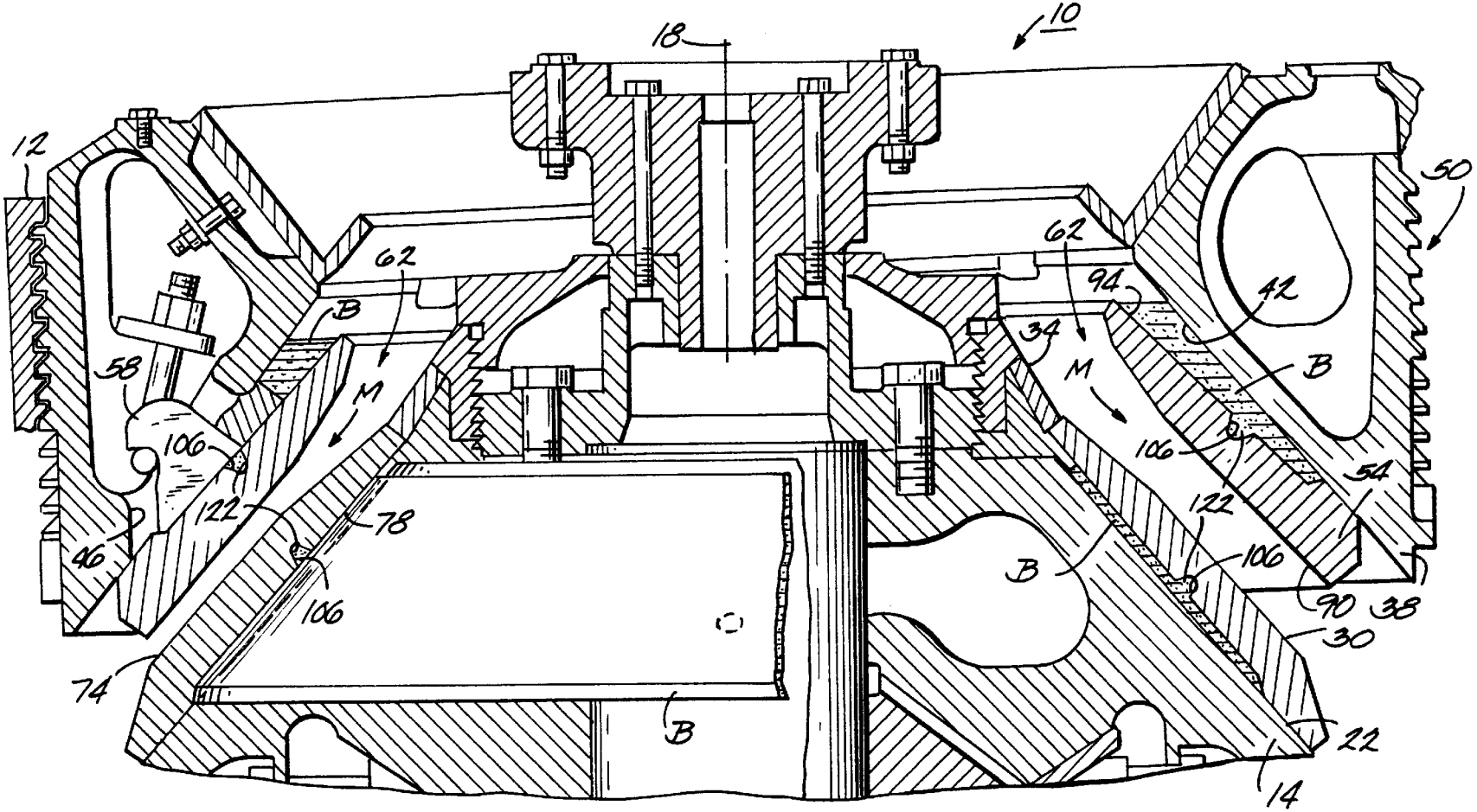
FIG. 1 is a cross-sectional view of a portion of a cone crusher embodying the present invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

A cone crusher 10 embodying the invention is illustrated in the drawings. As shown in FIG. 1, the cone crusher 10 includes a frame 12 (a portion shown in FIG. 1) and a drive system (not shown). The cone crusher further includes a head 14 supported by the frame 12 and driven by the drive system for eccentric rotation about a central axis 18. The head 14 provides a generally frusto-conical mantle mounting surface 22. An annular ridge 26 extends from the lower portion of the head 14 about the periphery of the mantle mounting surface 22. The purpose for the ridge 26 is explained below.

The cone crusher further includes a mantle 30 supported on mantle mounting surface 22. The mantle 30 has a generally frusto-conical shape that is complementary to the outer surface of the head 14 but that has portions spaced from the mantle mounting surface 22. When the mantle 30 is placed on the head 14, the lower radial extent or edge 32 of the mantle 30 engages the annular ridge 26. The mantle 30 is secured to the head 14 by a lock ring 34. The lock ring 34 threadedly engages an upper portion of the head 14 and engages the mantle 30. The mantle 30 is thus mounted on the head 14 and secured between the ridge 26 and the lock ring 34.

The cone crusher 10 further includes a bowl 38 which is supported by the frame 12 and which includes a generally frusto-conical bowl liner mounting surface 42. The bowl liner mounting surface 42 defines slots 46 spaced about the circumference of the bowl liner mounting surface 42. The bowl 38 is supported on the adjustment ring through threads and is movable along the axis 18 relative to the head 14 by turning it in relation to the adjustment ring 50 (partially shown) which is supported on the frame in a conventional manner.

Figure 5:
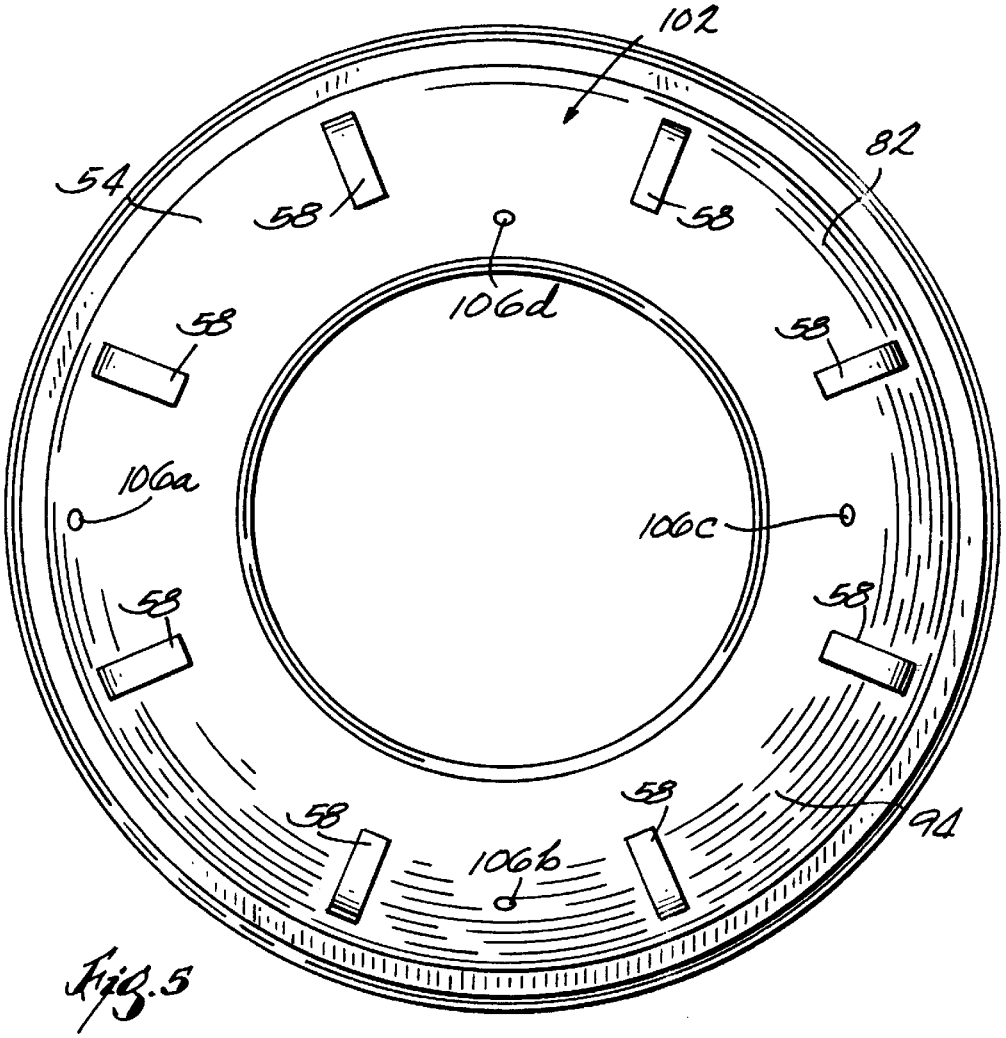
FIG. 5 is a top view of the bowl liner shown in FIG. 1.
Figure 6:
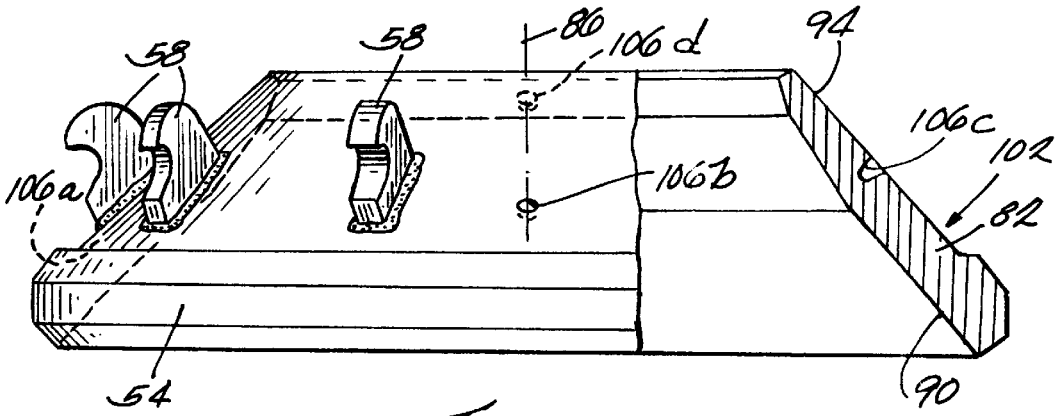
FIG. 6 is an elevational view taken in partial section of the bowl liner shown in FIG. 5.

The cone crusher 10 further includes a bowl liner 54 mounted on the bowl 38. The bowl liner 54 has a frusto-conical shape that is generally complementary to the shape of the bowl liner mounting surface 42. The bowl liner 54 may be supported on the bowl 38 in any conventional manner. In the illustrated construction of the bowl 38 and bowl liner 54 (see FIGS. 1, 5, and 6), the bowl liner 54 is mounted on the bowl 38 by hooks 58 extending from the periphery of the bowl liner 54. The hooks 58 are spaced apart on the outer surface of the bowl liner 54 and extend through the slots 46 in the bowl liner mounting surface 42. Respective, the bowl 38 and bowl liner 54 are supported on the adjustment ring to form (see FIG. 1) an annular space 62 between the mantle 30 and the bowl liner 54.

The cone crusher 10 further includes a backing material B. After the mantle 30 is mounted on the head 14, the backing material B is poured into the clearance between the mantle mounting surface 22 and the mantle 30 to ensure that the mantle 30 is properly supported by the head 14. Similarly, after the bowl liner 54 is mounted on the bowl 38, the backing material B is poured into the clearance between the bowl liner mounting surface 42 and the bowl liner 54 to ensure that the bowl liner 54 is properly supported by the bowl 38. The backing material can be any suitable material, such as expoxy resin, that can be poured into the clearance and flow between the liner and supporting surface, and that will cure or harden after it has flowed into position. Once the backing material B is set, the backing material B ensures that even pressure will be applied on the outer surface of the mantle 30 and the bowl liner 54.

The cone crusher 10 further includes a feeder (not shown) which feeds a relatively large-sized aggregate material M to be crushed by the cone crusher 10 into the upper portion of the cone crusher 10. The head 14 and the mantle 30 rotate eccentrically about the axis 18, causing the annular space 62 to vary. As the distance between the mantle 30 and the bowl liner 54 varies, the large particles are impacted by, and compressed between, the mantle 30 and the bowl liner 54. In this manner, the material M is crushed and reduced down to the desired product size.

Figure 2:
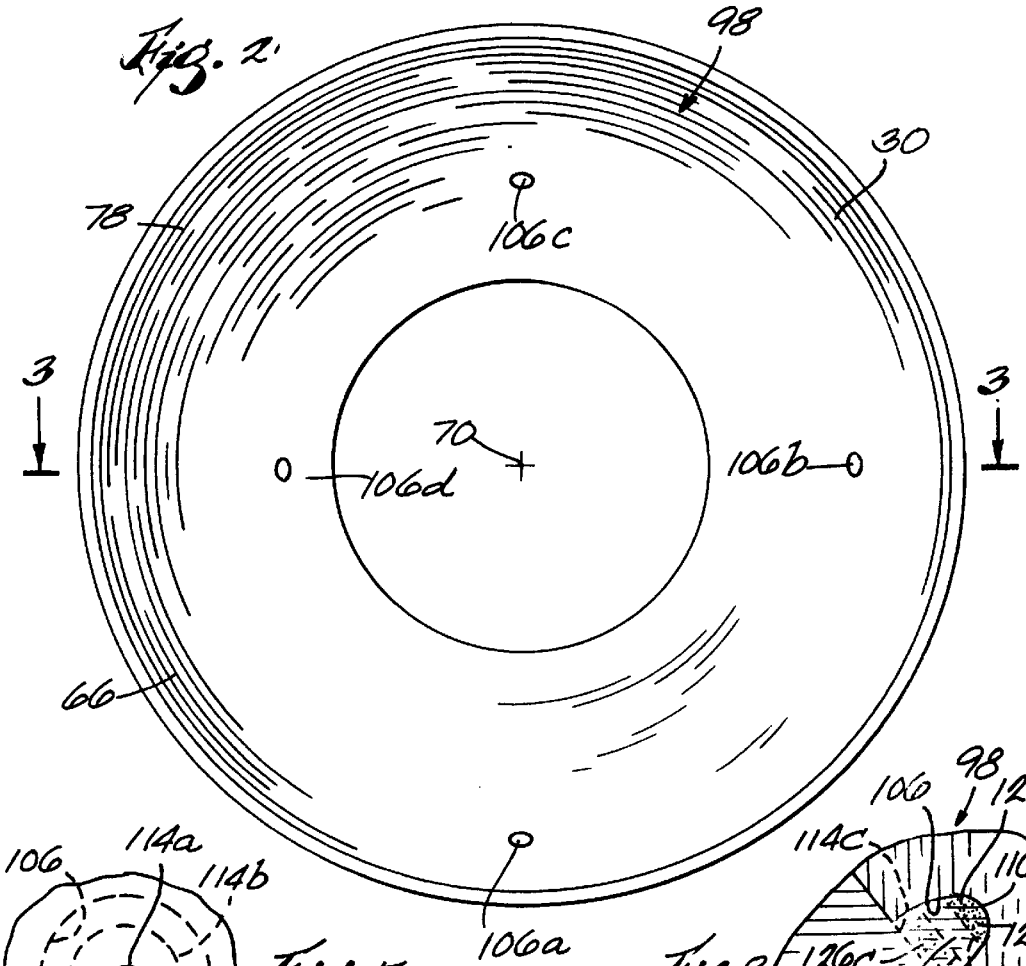
FIG. 2 is a bottom view of the mantle shown in FIG. 1.

The mantle 30 includes (see FIGS. 2 and 3) a generally frusto-conical body 66. The body 66 defines an axis 70 which, when the mantle is on the head 14, aligns with the axis 18. The body 66 includes a first or wearing surface 74 which engages the material M. The body 66 also includes a second or non-wearing surface 78 which faces opposite the wearing surface 74 and which faces the mantle mounting surface 22 of the head 14.

The bowl liner 54 includes (see FIGS. 5 and 6) a generally frusto-conical body 82 which defines an axis 86 and which includes a first or wearing surface 90. When the bowl liner 52 is mounted on the bowl 38, the axis 86 intersects with axis 18 and axis 70, and the wearing surface 90 faces towards the head 14 and the mantle. The body 82 also includes a second or non-wearing surface 94 which faces opposite the wearing surface 90 and which faces towards the bowl liner mounting surface 42 of the bowl 38.

The cone crusher 10 further includes (see FIGS. 2 and 3) means 98 for indicating wear of the wearing surface 74. The cone crusher 10 also includes (see FIGS. 5 and 6) means 102 for indicating wear of the bowl liner 54 and for indicating wear of the wearing surface 90. The means 98 and 102 for indicating wear are substantially identical and, therefore, only the means 98 for indicating wear will be described in detail. Common reference numerals indicate common elements.

While various suitable constructions can be successfully used, in the illustrated embodiment, means 98 for indicating wear (see FIGS. 2 and 3) includes a plurality of recesses 106 located in the non-wearing surface 78. The recesses 106, spaced from the wearing surface 74 a predetermined distance and each have an apex 110 which has (see FIGS. 7 and 8) a cross-section that varies with respect to the depth of the recess 106. The recess 106 is wider at the non-wearing surface 78 and narrows as it reaches the apex 110. In the illustrated construction (as shown in FIGS. 2–4 and 7–8), with respect to the axis 74, the recess 106 is wider (transverse to the axis 74) at the axial center and narrows towards the axial edges. Similarly, with respect to the circumference of the body 66, the recess is wider (transverse to the circumference) at the circumferential center and narrows toward the circumferential edges.

As the wearing surface 74 erodes through operation of the crusher 10, the material of the mantle 30 is thinned. Eventually, the recess 106 is revealed through the wearing surface 74 and becomes visually observable upon a predetermined degree of erosion of the wearing surface 74. At this point, the thickness of the mantle 30 is known because the wearing surface 74 has been subjected to a predetermined amount of wear. The remaining useful life of the mantle 30 is, therefore, also made more easy to calculate.

Figure 7:
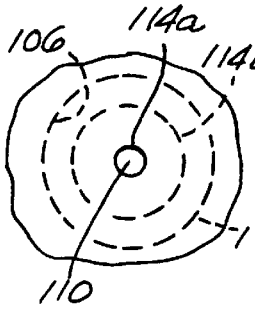
FIG. 7 is a view from the apex of a recess shown in FIG. 1.

More particularly, and as best shown in FIG. 7, the apex 110 of the recess 106 is revealed through the wearing surface 74. The portion of the recess 106 that is revealed has a circumference 114. The circumference 114 of the recess 106 that is revealed through the wearing surface 74 represents a specific degree of erosion of the mantle 30 and the wearing surface 74. The circumferences 114*a–c* each indicate a different degree of wear. Circumference 114*a* represents an initial amount of wear of the mantle 30 to a point near the apex 110. Circumferences 114*b* and 114*c* (shown in dashed lines in FIG. 7) indicate progressively greater amounts of wear.

Figure 3:
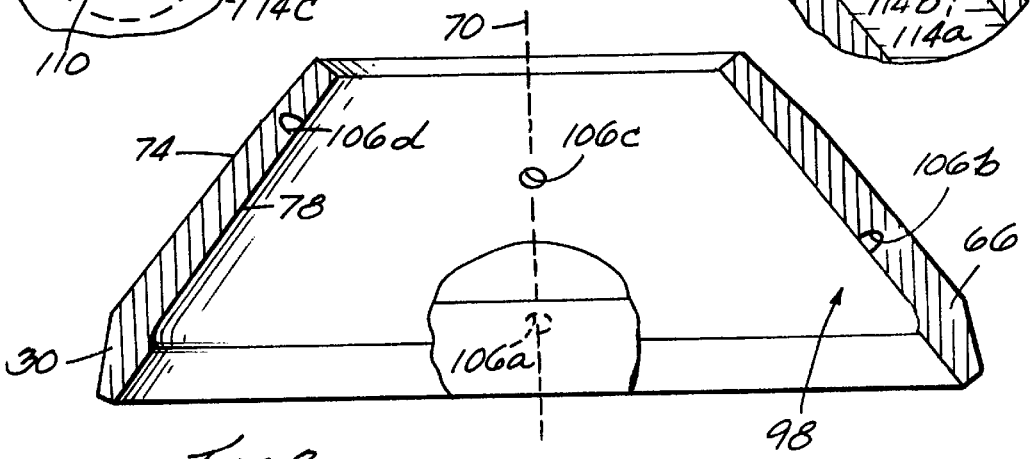
FIG. 3 is a cross-sectional view taken generally along line 3—3 in FIG. 2.

In the embodiment, the means 98 for indicating wear includes four recesses 106*a–d* which are spaced apart in the non-wearing surface 78 of the mantle 30. As shown in FIG. 3, the recesses 106*a–d* are spaced apart in the non-wearing surface 78 with respect to the axis 70 of the body 66 and are also circumferentially spaced apart (FIG. 2) in the non-wearing surface 78 to form a helical arrangement. The helical arrangement of the recesses 106*a–d* begins with recess 106*a* located at a point that is radially spaced from the axis 70. The helical arrangement continues around the circumference of the mantle 30 with recesses 106 *b–d* being located progressively radially closer to the axis 70.

Figure 4:
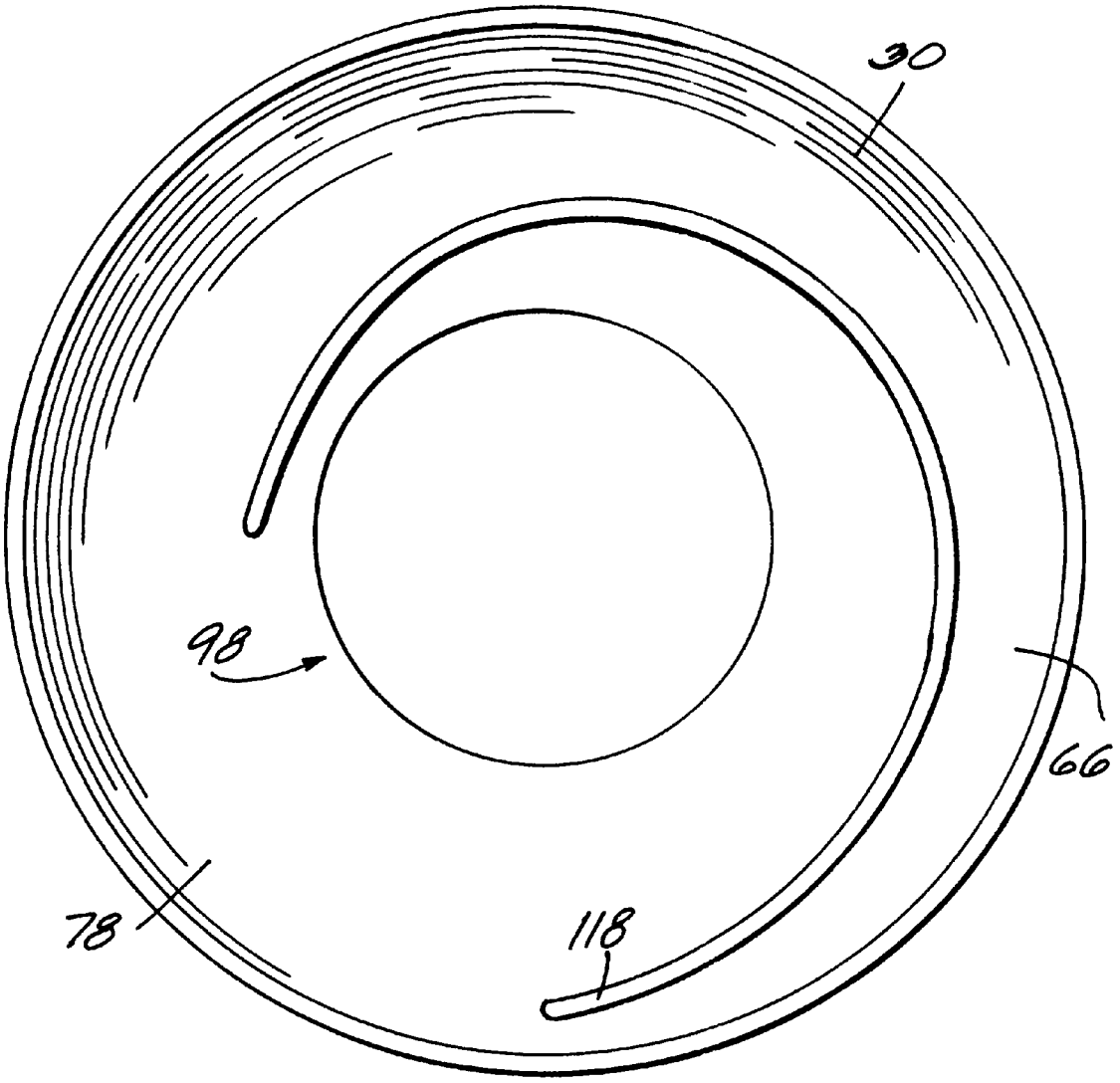
FIG. 4 is a bottom view of a mantle which is similar to that shown in FIG. 2 and which is a second embodiment of the invention.

As shown in FIG. 4, the means 98 may alternatively be in the form of a single groove 118 located in the non-wearing surface 78 and extending toward the wearing surface 74. Similar to the arrangement of recesses 106 shown in FIG. 2, the groove 118 begins at a point which is spaced radially from the axis 70 and continues around the circumference of the body 66 to a terminal point spaced radially closer to the axis 70.

Figure 8:
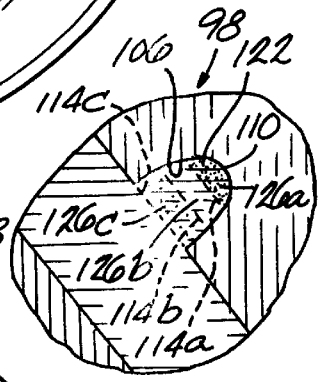
FIG. 8 is a cross-sectional view of a recess and the filler material shown in FIG. 1.

The means 98 for indicating wear of the mantle 30 also includes (see FIGS. 1 and 8) a filler material 122 which occupies each of the recesses 106. When the wearing surface 74 is worn, the filler material 122 is revealed to the extent the recesses 106 are revealed. As shown in FIG. 8, the filler material 122 includes a plurality of layers 126*a–c*. The layers 126*a–c* may be differentiated in numerous ways including by color or by chemical composition to define strata indicating the degree of erosion. More particularly, in a manner similar to the varied circumferences 114*a–c* of the recesses 106, each of the layers 126*a–c* indicates a different degree of erosion of the mantle 30 or wearing surfaces 74. When the filler material 122 is first revealed through the wearing surface 74, the layer 126*a* is revealed through the wearing surface 74, indicating an initial amount of wear. As the wearing surface 74 further erodes, the layer 126*b* and then the layer 126*c* are revealed through the wearing surface 74.

The filler material 122 may be the same as the backing material B and may be poured between the head 14 and the mantle 30 so that it fills the recesses 106*a–d*. Alternatively, however, a suitable filler material 122 different from backing material B may be filled into the recesses 106 before the mantle 30 is put in place so as to provide various strata 126*a–c*.

The means 98 for indicating wear thus provides indicia of when the mantle 30 or the wearing surface 74 is "fully worn". As used herein, "fully worn" is the degree of erosion or thinning of the mantle 30 that maximizes the useful life of the mantle 30 while preventing the head 14 from being damaged. "Fully worn" represents a predetermined degree of erosion and the remaining thickness of the mantle 30 at which point the mantle 30 should be replaced to avoid the risk of damage to the head 14. As discussed above, "fully worn" may be indicated by a specific circumference 114*c* of the recess 106 that is revealed through the wearing surface 74. "Fully worn" may also be indicated by a given layer 126*c* of the filler material 122 that is revealed through the wearing surface 74. In the preferred embodiment, both the circumference 114*c* and the layer 126*c* indicate that the mantle 30 and the wearing surface 74 are "fully worn".

Once the means 98 for indicating wear indicates that the mantle 30 or the wearing surface 74 is "fully worn", the mantle 30 is removed and replaced. In this manner, the means 98 for indicating wear ensures that the mantle 30 is replaced before the head 14 is damaged by overuse of the mantle 30. The means 98 for indicating wear also maximizes the useful life of the mantle 30 by preventing premature replacement of the mantle 30.

In a similar manner, the means 102 for indicating wear indicates when the bowl liner 54 and the wearing surface 94 are "fully worn". At that point, the bowl liner 54 is replaced. In this manner, the means 102 for indicating wear ensures that the bowl 38 is not damaged by overuse of the bowl liner 54. The means 102 for indicating wear also maximizes the useful life of the bowl liner 54 by preventing premature replacement of the bowl liner 54.

Various features of the invention are set forth in the following claims.

We claim:

1. A cone crusher for crushing a material, said cone crusher comprising:

a frame;

a head rotatably supported on said frame for eccentric rotation about an axis;

a bowl supported on said frame in spaced relation to said head, one of said head and said bowl providing a support surface;

a liner mounted on said support surface and having a wearing surface for engaging the material to be crushed and a non-wearing surface opposite said wearing surface, said liner defining a recess, said recess being revealed upon erosion of said wearing surface to indicate a degree of wear of said liner; and a backing material between said non-wearing surface and said support surface for transferring crushing force from said liner to said support surface, wherein a portion of said backing material occupies said recess, and wherein another portion of said backing material is outside of said recess and between said non-wearing surface and said support surface.

2. The cone crusher as set forth in claim 1 wherein said liner defines a plurality of recesses, and wherein at least one of said plurality of recesses is revealed through said wearing surface upon erosion of said wearing surface.

3. The cone crusher as set forth in claim 2 wherein said liner has an axis, and wherein each of said plurality of recesses are radially spaced apart with respect to said axis.

4. The cone crusher as set forth in claim 2 wherein said liner has a circumference, and wherein each of said plurality of recesses are spaced apart about said circumference.

5. The cone crusher as set forth in claim 2 wherein said plurality of recesses are spaced apart in a helix arrangement.

6. The cone crusher as set forth in claim 1 wherein said recess is a groove.

7. The cone crusher as set forth in claim 6 wherein said groove extends along a helical path.

8. The cone crusher as set forth in claim 1 wherein said liner has a non-wearing surface, and wherein said recess has an apex spaced from said non-wearing surface in the direction toward said wearing surface.

9. The cone crusher as set forth in claim 1 wherein said portion of said backing material occupying said recess includes a plurality of layers, and wherein each of said layers indicates a predetermined degree of erosion of said liner.

10. A cone crusher for crushing a material, said cone crusher comprising:

a frame;

a head supported by said frame for eccentric rotation about an axis;

a bowl supported on said frame in spaced relation to said head, wherein one of said head and said bowl provides a support surface;

a liner mounted on said support surface, said liner being formed of a material, said liner having a wearing surface engaging the material to be crushed and a non-wearing surface facing opposite said wearing surface and facing toward said support surface, said liner defining a plurality of recesses, said plurality of recesses being spaced apart in a helix arrangement, each of said plurality of recesses extending from said non-wearing surface toward said wearing surface; and a backing material between said support surface and said non-wearing surface and filling each of said plurality of recesses, a portion of said backing material being outside of said plurality of recesses and between said non-wearing surface and said support surface, said backing material being different from said material of said liner;

wherein at least one of said plurality of recesses and said backing material filling said at least one of said plurality of recesses is revealed through said wearing surface when said wearing surface is eroded to a predetermined degree to indicate that said wearing surface is worn.

11. The cone crusher as set forth in claim 1 wherein said liner is formed of a material, and wherein said backing material is different from said material of said liner.

12. The cone crusher as set forth in claim 1 wherein said recess is spaced from said wearing surface.

13. The cone crusher as set forth in claim 1 wherein said liner has an axis and a circumference, wherein said recess has a depth and a cross-section that varies with said depth, and wherein, when said cross-section of said recess is revealed, said cross-section indicates a predetermined amount of wear of said liner with respect to both said axis and said circumference of said liner.

14. A method of assembling a cone crusher, the cone crusher including a frame, a head rotatably supported on the frame for eccentric rotation about an axis, a bowl supported on the frame in spaced relation to the head, one of the head and the bowl providing a support surface, a liner mounted on the support surface, and a backing material, wherein the liner has a wearing surface for engaging a material to be crushed and a non-wearing surface, the liner defining a recess, the recess being revealed upon erosion of the wearing surface to indicate a degree of wear of the liner, said method comprising the steps of:

positioning the liner on the support surface so that the non-wearing surface faces toward the support surface; and positioning the backing material so that, when the liner is positioned on the support surface, the backing material is between the support surface and the non-wearing surface to transfer crushing force from the liner to the support surface, so that a portion of the backing material occupies the recess, and so that another portion of the backing material is outside of the recess and between the non-wearing surface and the support surface.

15. The method as set forth in claim 14 wherein, said step of positioning the backing material includes, after the liner is positioned on the support surface, pouring the backing material between the support surface and the non-wearing surface so that the portion of the backing material flows into the recess.

* * * * *